US005494066A

United States Patent [19]

McMahan

[11] Patent Number: 5,494,066

[45] Date of Patent: Feb. 27, 1996

[54] INSECT PROOF BRIDLE TETHERED ENCLOSURE FOR COTS, BEDS AND THE LIKE

[76] Inventor: Allan W. McMahan, 4311 Goldfinch, Houston, Tex. 77035

[21] Appl. No.: 282,541

[22] Filed: Jul. 29, 1994

[51] Int. Cl.[6] ..... E04H 15/00

[52] U.S. Cl. ..... 135/87; 135/90; 135/116; 135/123; 5/414

[58] Field of Search ..... 5/414, 512, 97; 135/90, 121, 87, 117, 123, 124, 128, 133, 135, 116

[56] References Cited

U.S. PATENT DOCUMENTS

| | | | |
|---|---|---|---|
| 124,239 | 3/1872 | Winslow | 5/414 X |
| 294,088 | 2/1884 | Smith | 135/90 |
| 671,912 | 4/1901 | Woodward | 135/90 |
| 739,024 | 9/1903 | Palmer | 135/90 |
| 785,571 | 3/1905 | Raines et al. | 5/414 X |
| 849,808 | 4/1907 | Palmer | 135/90 |
| 2,301,511 | 11/1942 | Boyce | 5/414 X |
| 2,764,993 | 10/1956 | Wallace et al. | 135/121 X |
| 2,931,373 | 4/1960 | Larson | 135/90 |
| 4,716,919 | 1/1988 | Griffin | 135/133 |

*Primary Examiner*—Wynn E. Wood

*Attorney, Agent, or Firm*—Bush, Moseley, Riddle & Jackson

[57] ABSTRACT

A tethered, bridle supported insect proof protective enclosure having top side and end walls composed of insect proof net fabric with the walls having bottom weighting for establishing insect sealed engagement with the ground, floor or other surface on which the apparatus is installed. The top wall is provided with an integrated supporting framework composed of a plurality of jointed support rods having ends thereof received within support pockets attached to the top wall and supported at intermediate portions thereof by means of support rings extending from reinforced support patches that are attached to the top wall. An embodiment may be provided having a floor and being of a single or double bed width and having ingress and egress through closures such as zippers or releasable fastener material that are used at wall openings. The insect proof protective enclosure is intended to be positioned with the walls thereof disposed in significantly spaced relation with the sides and ends of the cot or bed that in located within the enclosure. After installation of the insect proof enclosure its position may be readily changed to suit the needs and comfort of the user without requiring any disassembly for such purpose.

19 Claims, 4 Drawing Sheets

FIG. 1
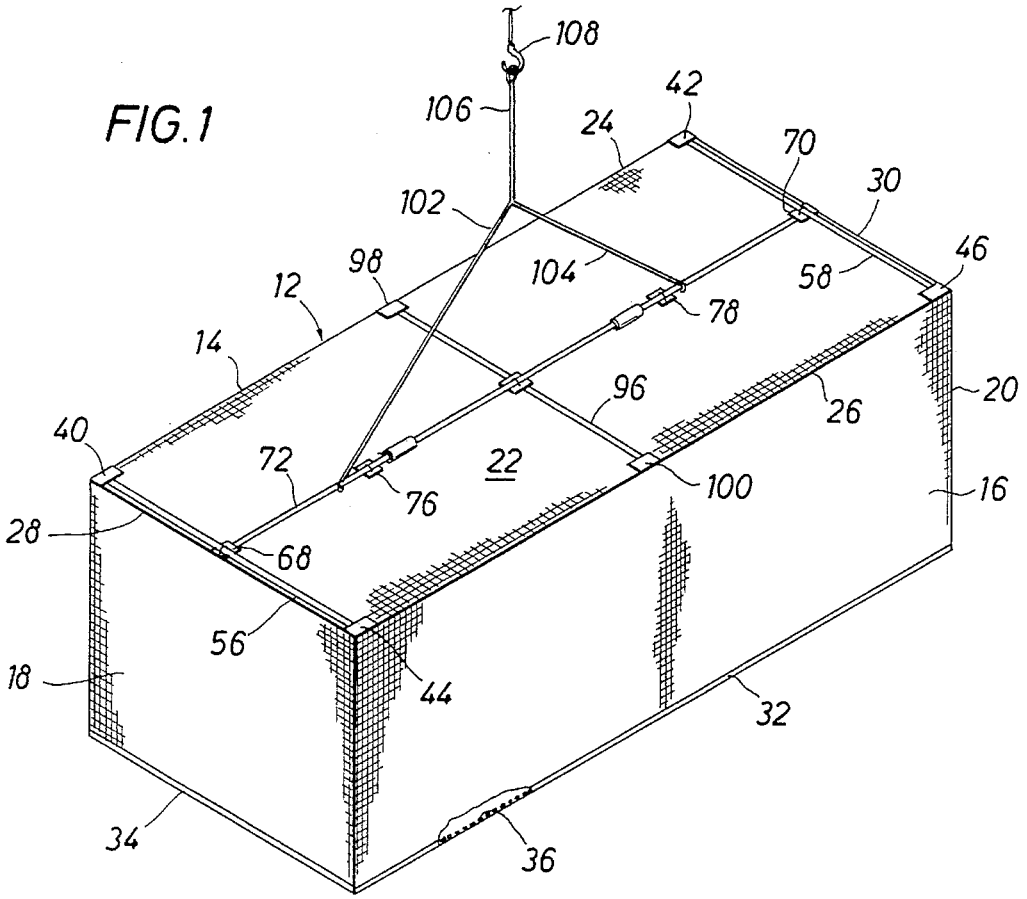
FIG. 2
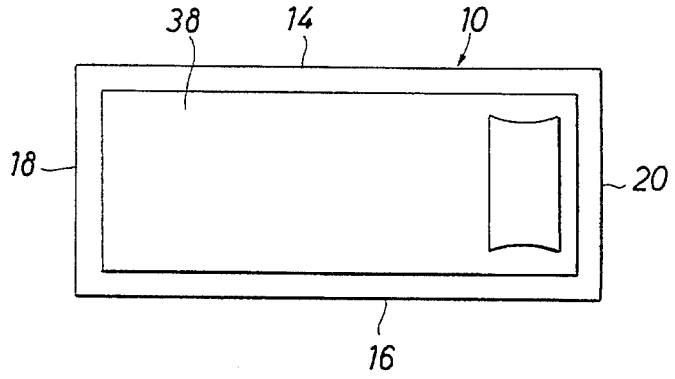
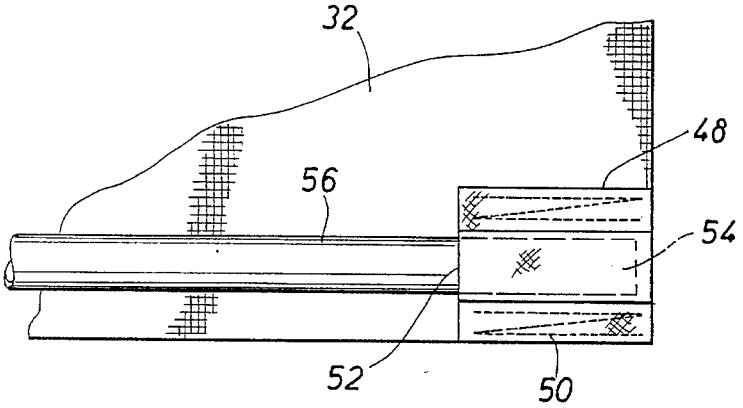
FIG. 3

FIG. 4
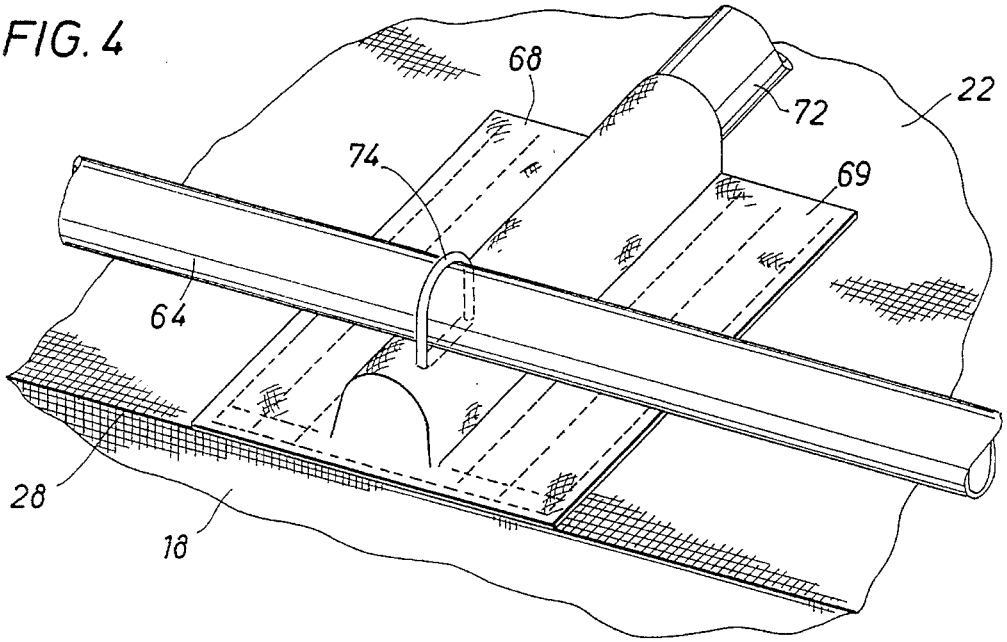
FIG. 5
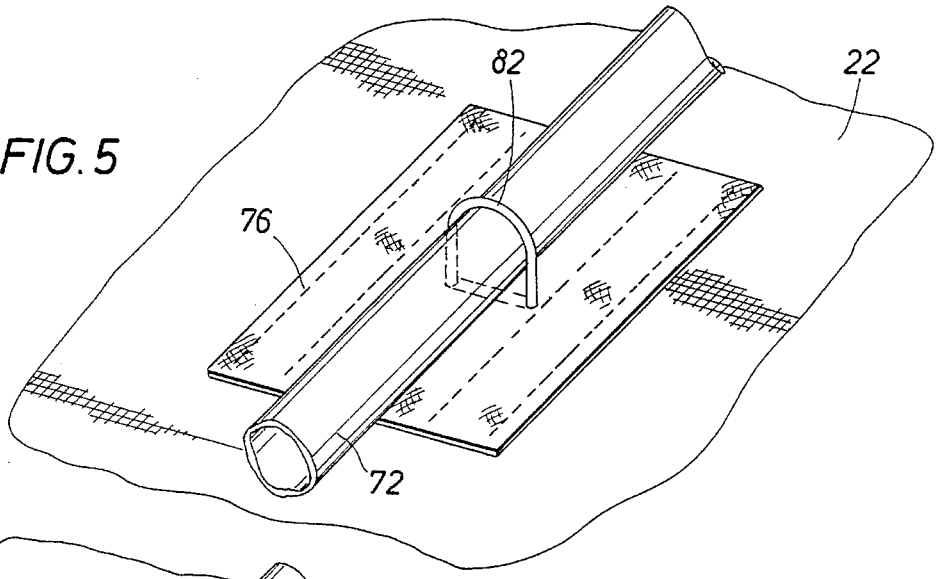
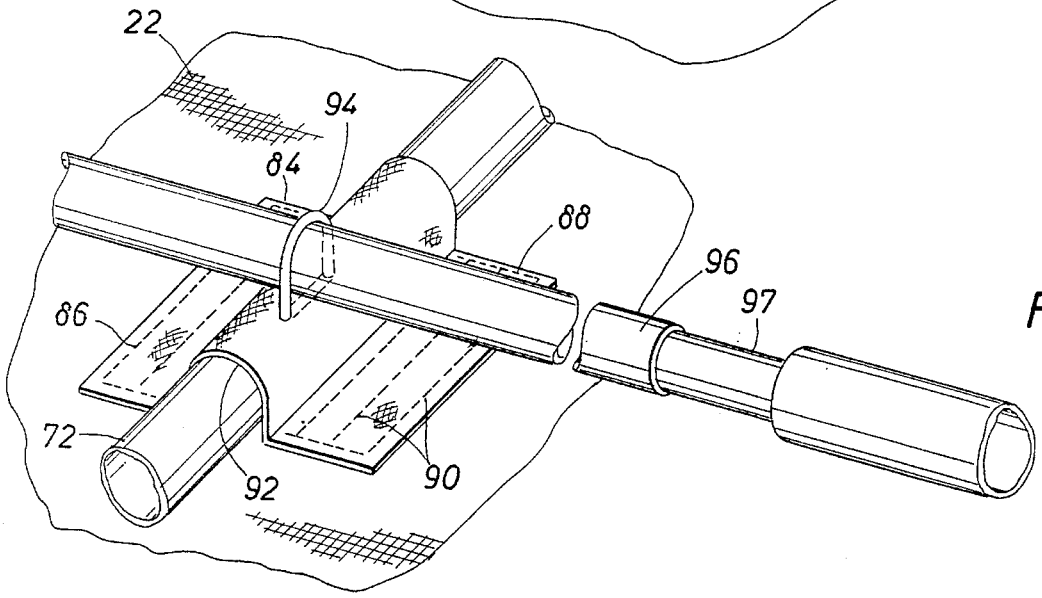
FIG. 6

INSECT PROOF BRIDLE TETHERED ENCLOSURE FOR COTS, BEDS AND THE LIKE

FIELD OF THE INVENTION

This invention relates generally to insect proofing for various types of sleeping systems to prevent insects such as mosquitos from having access to persons who are sleeping, resting or remaining within a relatively small insect proof space. More particularly, the present invention concerns a generally rectangular enclosure which is composed essentially of insect proof netting and which is supported from a single support by an integrated framework and support bridle arrangement for support of the enclosure from a single point.

BACKGROUND OF THE INVENTION

It is well known that many flying insects, including those that are active during daylight hours such as flies, gnats, bees etc. are frequently drawn to the location of a campsite or household due to the presence of foodstuffs and can be quite annoying due to their presence and because they tend to bite, sting, fly in close proximity to or land on the inhabitants. It is also well known that many flying insects that are active during nighttime hours as well as daylight hours, mosquitos being a prime example, are annoying to persons who are trying to sleep or rest because of their tendency to bite and feed on the blood of such persons. It is a medical fact that mosquitos are potential carriers of diseases such as malaria and encephalitis which can be extremely detrimental to the health of persons who have been bitten. It is desirable therefore to provide an insect proof protective enclosure within which persons can go for the purpose of avoiding contact with these insects even though the person may be otherwise located in an insect infested environment.

When households are located in an area having a high population of night flying insects such as mosquitos it is very difficult to begin a night without a few mosquitos in the home. These few mosquitos will be attracted by the body heat of those present within the home and at night, when the lights are out, will attempt to bite those persons present, especially those persons who are quiet and still, such as when sleeping. Such mosquito biting activity and the sound that mosquitos make when flying is a source of considerable annoyance to persons who are trying to sleep. Mosquitos are especially detrimental to infants who are relatively still or who are sleeping because infants cannot normally take action to frighten the mosquitos away. It is desirable therefore to provide an insect proof enclosure that can be efficiently and effectively used in the home to provide protection for the occupants from contact with the insects, especially while sleeping.

During outdoor activities such as camping those engaged in such activities are often subject to annoyance during daylight and nighttime hours by a variety of flying insects. It is desirable in many cases to provide an insect proof enclosure which can be used to avoid contact by flying insects during daylight and nighttime hours and yet permit the user or users to enjoy other aspects of the outdoor environment.

SUMMARY OF THE INVENTION

It is a principal feature of the present invention to provide a novel insect proof enclosure which can be used in the indoor or outdoor environment to exclude flying insects from a specific space intended to be occupied for the comfort of one or more users.

It is another feature of the present invention to provide a novel insect proof enclosure that is designed to be tethered from a single point and can easily be oriented to suit the needs of the user.

It is also a feature of the present invention to provide a novel insect proof enclosure that includes wall structures composed of insect proof netting material and which is normally positioned so that the walls thereof are located in spaced relation with a bed, cot, pallet, chair or other device that is used within the enclosure.

It is another a feature of the present invention to provide a novel insect proof enclosure that can be efficiently positioned by the user for comfort and convenience and, without necessitating disassembly of the enclosure, its position can be simply and efficiently changed.

It is an even further feature of the present invention to provide a novel insect proof enclosure that is bottom weighted at the side and end walls thereof to establish firm sealed engagement with the surface on which the enclosure is used and to stabilize the enclosure from inadvertent movement and to permit the position of the enclosure to be easily adjustable after the enclosure has been made ready for use.

It is another feature of the present invention to provide a novel insect proof enclosure that includes a lightweight easily stored support rod system that established integrated assembly with the top wall of the enclosure and permits the enclosure to be supported by a simple bridle assembly.

Among the several features of this invention is noted the contemplation of a novel insect proof protective enclosure which can incorporate an integral floor sheet or can be provided as a floorless embodiment and which is easily adapted for ingress and egress via the open bottom or via one or more closures the wall structure thereof.

Briefly, the several objects and features of the present invention are realized through the provision of an insect proof protective enclosure having a top wall, side walls and end walls and being composed essentially of insect proof netting material having a mesh size sufficiently small to exclude certain insects and large enough to permit air circulation and allow visibility through the walls. At their bottoms the walls define an elongate weight pocket or pockets which contain desired weighting to urge the walls into insect sealed relation with a floor, the ground or other surface above which the enclosure is situated. The weighting may conveniently take the form of a plurality of weights that are spaced along the length of the weight pockets or may take the form of one or more lengths of weighting material such as chain weight material. Engagement of the weighted lower portions of the walls enables the position of the enclosure to be established and stabilizes and prevents inadvertent movement of the tethered and suspended enclosure. The position of the enclosure can be simply and efficiently changed by changing the position of the weighted lower portions of the walls relative to the floor, ground or other surface engaged thereby. It is not necessary to disassemble the enclosure or its integrated framework or support to accomplish change of its position. To change the location of the protective enclosure with the room or other environment it is necessary only to change the point from which the enclosure is suspended. This can be accomplished in a few minutes time without the need for any special tools.

The upper portion of the insect proof protective enclosure is provided with a support framework which is integrated with the top wall so as to provide both positioning and support for the enclosure. This integrated framework comprises a plurality of pockets and ring supports which are fixed to the top wall of the protective enclosure and a plurality of support rods having ends received within respective support pockets and certain intermediate portions being received within respective support rings. The support pockets and support rings are positioned to orient the top wall to its full extent and to provide oriented support for the side and end walls. This feature enables the enclosure to be suspended in such manner that the side and end walls will be spaced from the cot, bed, sleeping bag or other apparatus that is located within the enclosure. Suspension of the insect proof protective enclosure is accomplished by a bridle that is connected to the support framework and having a single support element such as a cord, chain, wire etc. which is received by any suitable overhead support such as a hook, rod, tree limb or other support device. The enclosure is lightweight and, when not assembled, can be folded or rolled to establish a small, short dimension for ease of storage, handling or transportation.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

In The Drawings:

FIG. 1 is an isometric illustration of a supported insect proof enclosure which is manufactured according to the teachings of the present invention;

FIG. 2 is a partial sectional view taken along a horizontal plane in FIG. 1 and showing the relationship of the insect proof enclosure to a bed, cot or sleeping situate therein;

FIG. 3 is a fragmentary plan view of the top wall of FIG. 1 showing a corner support pocket thereof and a transverse support rod being located therein.

FIG. 4 is a fragmentary isometric illustration showing a central rod receiving pocket and support of the insect proof enclosure of FIG. 1 which is located substantially centrally of respective ends of the top wall.

FIG. 5 is a fragmentary isometric illustration of a portion of the top wall of FIG. 1 showing one of the support elements for the intermediate longitudinal rod thereof in detail;

FIG. 6 is a fragmentary isometric illustration of the central portion of the top wall showing the intermediate support receptacle and longitudinal and transverse rods being positioned in supporting relation therewith;

DETAILED DESCRIPTION OF PREFERRED EMBODIMENTS

Figure 7:
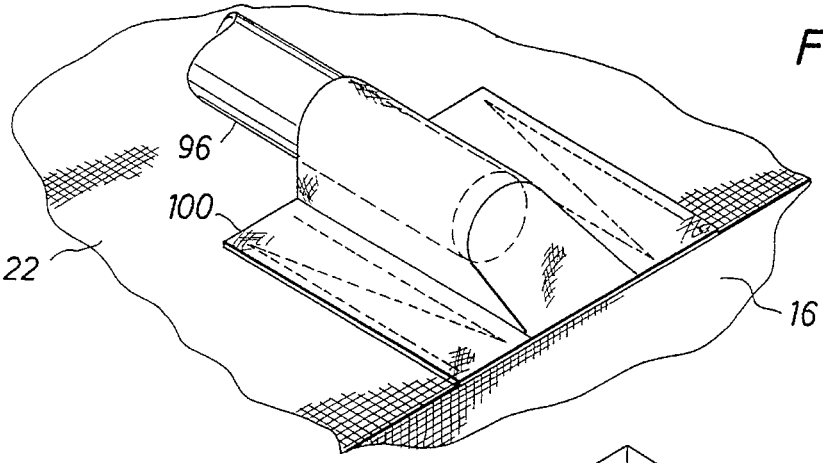
FIG. 7 is a fragmentary isometric illustration showing an intermediate side support pocket of the top wall and a transverse support rod being located therein.

Referring now to the drawings and first to FIGS. 1–5, an insect proof supported enclosure constructed in accordance with the present invention is illustrated generally at 10 and incorporates a generally rectangular enclosure shown generally at 12 and having generally rectangular sidewalls 14 and 16 which are integral with or connected to a pair of opposed generally rectangular end walls 18 and 20. The side and end walls may be interconnected together by seams defining corners of the enclosure 10 or they may be defined by a single length of insect netting material having a desired width and having the ends seamed together by sewing or by any other suitable means of attachment. In the preferred embodiment of FIG. 1 which is a floorless embodiment, the insect proof enclosure 10 is completed by the provision of a generally rectangular top wall 22 which is also composed of insect proof netting material and which is sewn or otherwise attached to the respective side and end walls at longitudinal side seams 24 and 26 and transverse end seams 28 and 30. The side and end seams 24–30 define upper elongate corners that establish the longitudinal and transverse extent of the insect proof enclosure.

It is desirable to establish engagement between the side and end walls of the enclosure and a floor or other surface in such a manner that small insects such as mosquitoes, flies, gnats, etc. cannot enter the protected enclosure through minute cracks between the walls and the floor. To provide this feature the sidewalls 14 and 16 define elongate side and end weight containing pockets such as shown at 32 and 34 in FIG. 1. Within these elongate pockets is located weighting material such as a length or lengths of weighted material or a plurality of weights that provide sufficient downward force on the side and end walls to establish firm, insect sealed engagement with a floor or other surface contacted thereby. It has been determined that jointed weighted material such as chain rope 36 when installed within these lower pockets of the walls will securely hold the side and end walls into firm, sealed contact with the floor, ground or other surface. The weighting material of the lower pockets of the side and end walls also stabilizes the position of the enclosure and permits easy change of the position of the enclosure as will be explained in detail hereinbelow.

It is desirable to support the insect proof enclosure 10 in such a manner that it is disposed in spaced relation with a sleeping lounging or sitting device such as a cot, bed, pallet, sleeping bag or other device 38 which is typically positioned within the enclosure and so that the respective side and end walls 14–20, when the enclosure is so supported, will be disposed in spaced relation with the ends and sides of the sleeping device. Since the ends and sides of the sleeping or lounging device 38 will be in spaced relation with the respective side and end walls of the protective enclosure, any insects that might be present on the wall of the enclosure will not have the capability of biting the user through the netting material because it is unlikely that the user's body will be contacted by the net walls of the enclosure.

It is desirable therefore to support the insect proof enclosure 10 in such manner that the walls 14–20 are in spaced relation with the cot or bed 38 as shown in FIG. 2 and the protective enclosure is stabilized against inadvertent movement. According to the present invention this feature is accomplished by providing an upper support structure for the protective enclosure. For this purpose the top wall 22 of the protective enclosure is provided with four corner pockets 40, 42, 44 and 46, one being shown in detail in a fragmentary plan view of FIG. 3. Each of these corner pocket members is defined by a patch of strong fabric material such as Nylon fabric, as shown at 47 in FIG. 3, which is sewn or otherwise attached to the light weight insect proof net material of the top wall 22. As shown in the example of FIG. 3, these fabric patches are each affixed at opposite wing portions 48 and 50 thereof to the net material of the top wall 22 so as to define a transverse support pocket or receptacle 52 that receives a respective end portion 54 of transverse end support rods 56 and 58. Intermediate the width of the respective end portions of the top wall 22 reinforced pocket members 68 and 70 are provided which serve to receive respective ends of a longitudinal central support or "spine" rod 72. The support patches 68 and 70 are each provided with ring or loop type support elements such as shown at 74 in FIG. 4 which receive the respective transverse end rods 64 and 66 and provide support for the support patch and thus the top wall in the region of the pocket patches 68 and 70. The pocket patches 68 and 70 may be attached to the fabric screen material of the top wall by sewing stitches 69 as shown in FIG. 4 or by any other suitable means of attachment. As shown in FIG. 1 for intermediate support of the top wall 22 a pair of intermediate support patches 76 and 78, as shown in greater detail in FIG. 5, are sewn or otherwise attached to the top wall 22 by stitching 80 which adheres and reinforces the support patches in assembly with the net material of the top wall. A ring type support member such as a D-ring support element 82 extends through the support patch and provides an opening to receive the longitudinal intermediate support or spine rod 72.

Further support is provided for the central portion of the top wall 22 as shown in FIG. 6 by a central support patch 84 having spaced wing members 86 and 88 which are adhered to the top wall 22 by means of reinforced stitching 90 or by any other suitable means of attachment. The spaced support wings 86 and 88 are positioned so as to define an intermediate through passage 92 through which the longitudinal intermediate support rod 72 extends. Centrally of the support patch 84 is provided a support ring 94 which, as shown may conveniently take the form of a D-ring having an arcuate portion thereof extending through the support patch and being exposed for receiving an intermediate transverse support rod 96. If desired the preferably jointed support rods may be of tubular configuration as shown in FIG. 6 and may have an internal elastic core 97 such as a bungee cord as secured the rod joints in connected relation and yet allow separation and folding of rod sections at the joints to permit ease of storage and handling of the protective enclosure. The intermediate transverse support rod is also positioned with its ends located within support pockets defined by intermediate support patches 98 and 100 as shown in FIG. 1 and as shown in greater detail in FIG. 7.

Although the support rods could be defined by an integral single lengths of support rod material such as fiberglass, graphite or any one of a number of suitable polymer materials typically the support rods will be jointed for ease disassembly and storage. The longitudinal support or spine rod 72 will typically be defined by three interconnected rod sections while the transverse support rods 64, 66 and 96 will typically be defined by two interconnected rod sections. The interconnection between the rod sections will typically be slip joints and the rod sections can be interconnected by elastic cord material such as bungee cord material in other that the rod sections may be uncoupled and the rod folded to a suitable length for storage in a relatively small space. Jointed rods interconnected by elastic cord material are widely in use at the present time for tent ribbing in the camping and outdoor equipment industry. These jointed rod sections enable the longitudinal and transverse support rods to be quickly assembled to define a lightweight framework for support of the insect proof enclosure.

As mentioned above it is desirable to provide means for supporting the insect proof enclosure in a manner such that its side and end walls are disposed in spaced relation with a cot or bed or any other equipment that is located within the enclosure such as shown above in FIG. 2. For this purpose and because of the interrelated structural relationship of the lightweight framework defined by the longitudinal and transverse support rods with the multiple support patches, pockets, etc. defines an integrated, generally rectangular support frame structure. When the frame structure is properly supported the side and end walls of the protective enclosure will hang substantially vertically by virtue of the chain rope or other weighted elements within the side and end pockets 32 and 34 at the lower portions of the side and end walls. For support of the integrated frame work of the insect proof protective enclosure a support bridle is provided having a pair of bridle elements 102 and 104 which are composed of any suitable support cord material, with the respective ends thereof being secured to the intermediate longitudinal support rod 72 on either side of the intermediate support patches 76 and 78. The bridle elements 102 and 104 are connected at the upper ends thereof to a single support cord 106 which can be suspended from a single point such as by a suspension hook 108 that is turn supported by the ceiling of a room, a structural member of a tent or by any other suitable means of support. The support cord 106 may also be tied or otherwise secured to an overhead tree limb or any other overhead support. Although the insect proof supported enclosure 10 is supported by a single support cord 106 it will not inadvertently rotate and become misoriented even though it is supported from a single point because the weighted lower ends of the side and end walls will have sufficient contact with the floor or other surface to retard any tendencies of the enclosure to inadvertently rotate. For ingress and egress by the user a side, end or even a corner portion of the side and end walls of the insect proof enclosure may be raised from the ground or floor so that a person can quickly enter or exit the enclosure without significant risk that insects might enter the enclosure. If a few insects such as mosquitos manage to enter the enclosure while the user is entering these insects can be quickly dispatched through the application of a small amount of a suitable insect spray. Since the end and side walls of the unit are in spaced relation with the cot or bed occupied by the user, the user can move about significantly, which is typically the case during sleeping, without inadvertently coming into contact with the side and end walls. Therefore any biting insects such as mosquitos externally of the enclosure can not bite the user through the enclosure under normal circumstances. Also, when the user is leaving the cot, sleeping bag, etc. the user will be able to stand beside the sleeping device while remaining within the protective enclosure. Thus the user is not required to leave the insect proof environment of the enclosure while getting dressed.

Figure 8:
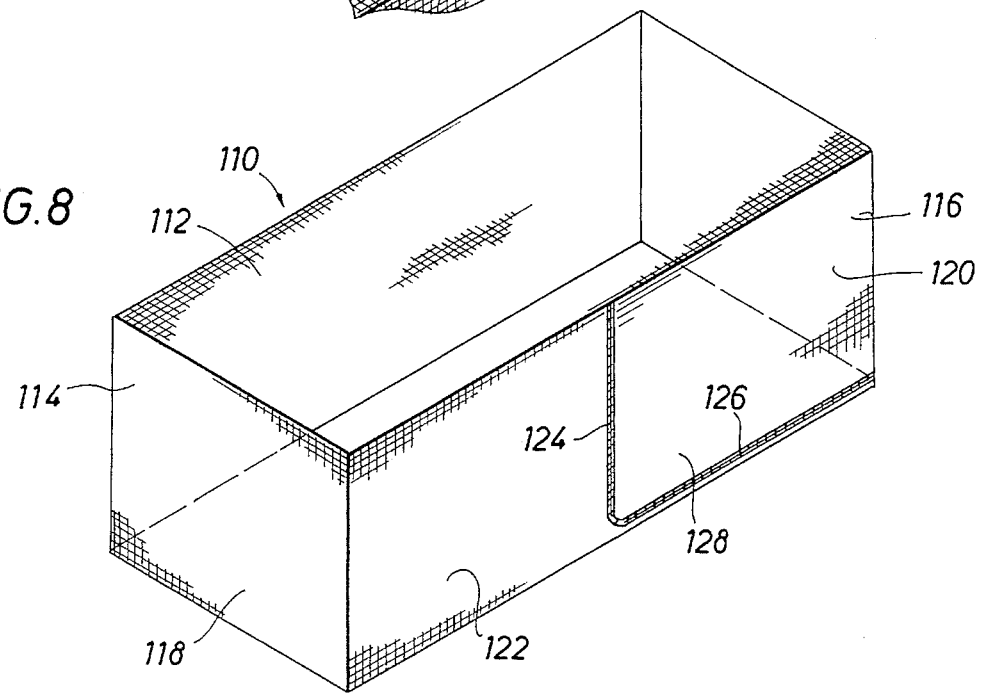
FIG. 8 is an isometric illustration of an alternative embodiment of the present invention incorporating a rectangular floor and further incorporating a zipper closure for one of the sidewalls to permit ingress and egress of the user or users.

As shown in FIG. 8 an alternative embodiment of the present invention is shown which will be provided with a support frame work structure such as shown and described above in connection with FIG. 1. The frame work components are not shown in FIG. 8 for the purpose of simplicity. The alternative embodiment 110 of FIG. 8 includes a top wall 112 a pair side walls 114 and 116 and end walls 118 and 120. The insect proof enclosure of FIG. 8 also includes a bottom wall 122 which is of generally rectangular configuration and is sewn or otherwise attached at respective side and end portions thereof to the respective side and end walls of the unit. The side wall 116 of the protective enclosure unit of FIG. 8, to permit ingress and egress, is provided with vertical and horizontal zippers or other fasteners 124 and 126 which secure a movable zipper flap 128 defined by a portion of the side wall. For ingress and egress the user will simply unzip the zippers 124 and 126 and after entering or leaving the protective enclosure will close the zippers to thereby secure the side wall against entry of the enclosure by insects. Instead of zippers, the closure elements 124 and 126 may conveniently take the form of suitable strips of releasable fastening material such as is widely sold under the registered trademark VELCRO®.

Figure 9:
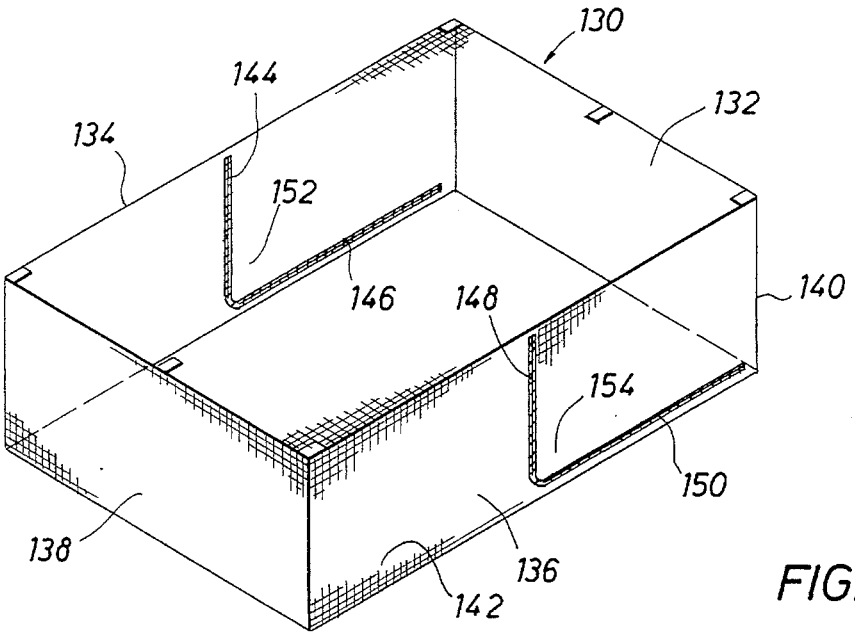
FIG. 9 is an isometric illustration of a further embodiment of this invention showing a double wide insect proof enclosure having zipper closures at both of the sidewalls for ingress and egress of the user.

As is evident from FIG. 9 a double wide embodiment of the present invention will conveniently take the form generally shown at 130 which is provided with a framework support similar to that shown in FIG. 1. The alternative embodiment of FIG. 9 is provided with a top wall 132 which is connected to side wall 134 and 136 and respective end walls 138 and 140. There is also provided a bottom wall 142 of rectangular configuration to which the side and end walls are firmly attached and sealed. The side walls 134 and 136 are provided with respective pairs of closure elements 144–146 and 148–150 to provide movable closure flaps 152 and 154 to enable ready ingress and egress of users from either side of a cot or bed. Here again, the releasable closures may conveniently take the form of zippers or strips of releasable fastener material as is suitable for the intended purpose of the user.

Figure 10:
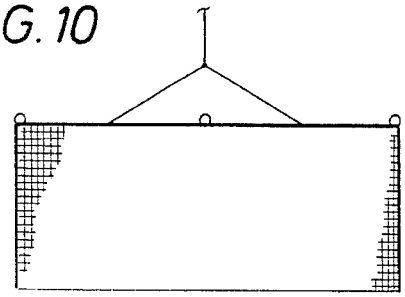
FIGS. 10–17 are each side elevational views of various embodiments of the present invention.
Figure 11:
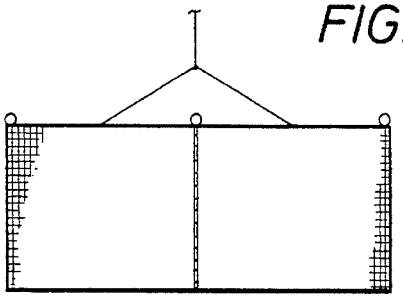

As shown in FIGS. 10–17 a number of different suitable embodiments are depicted by way of simple diagrammatic form FIG. 10 is illustrated of a single wide insect proof enclosure such as shown in FIG. 1 having top end and side walls with no bottom wall. As shown in FIG. 11 a single wide embodiment having a bottom wall is provided with a vertical zipper or other fastener to secure an opening through a side wall. For ingress and egress a user will simply open the vertical fastener and spread the fastener components apart to establish an opening of sufficient dimension for entering or leaving the protective enclosure.

Figure 12:
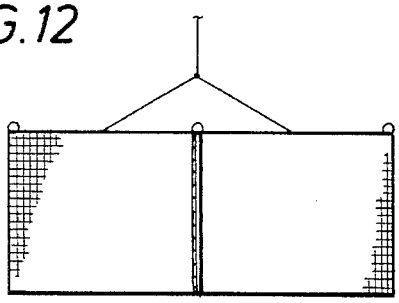
Figure 13:
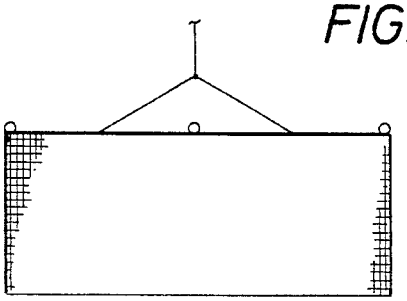

In the case of FIG. 12 a double wide insect proof enclosure is shown having a bottom wall and having vertical fasteners such as zippers in each of the side walls so as to permit ingress and egress of users from opposite sides of the unit. As shown in FIG. 13 a double wide insect proof enclosure is shown having an open bottom with ingress and egress of the users occurring by lifting the side walls as discussed above. In this case, like FIG. 10 the side and bottom walls are weighted as shown at 36 in FIG. 1 to secure the side and end walls in insect proof, sealed relation with the floor or other surface on which the side and end walls rest.

Figure 14:
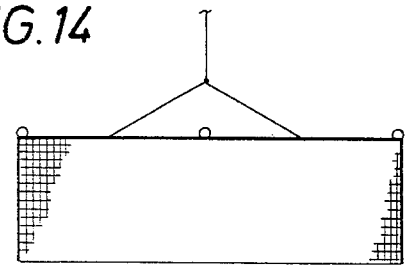
Figure 15:
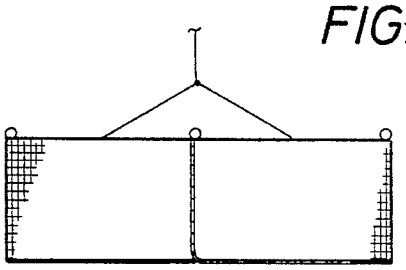
Figure 16:
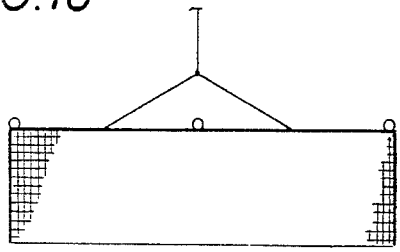
Figure 17:
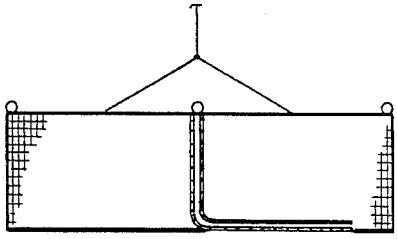

In FIG. 14 a single wide sleeping system is shown which is similar to that of FIG. 10 with the exception that the side and end walls are of less height to enable efficient use by persons having sleeping bags that rest on the floor, ground or other surface. FIG. 15 illustrates a similar insect proof enclosure as compared with that of FIG. 14 with the exception that it is provided with a bottom wall and with one of the side walls having vertical and horizontal closures such as zippers or releasable fasteners. FIG. 16 illustrates a double wide embodiment of the insect proof enclosure of this invention for use by two or more persons having sleeping bags that rest on the ground or other surface. Ingress and egress is accomplished by lifting the weighted bottom portions of the respective side walls. As shown in FIG. 17 a double wide insect proof enclosure is shown having a bottom wall with each of the side walls provided with zippers or other suitable closures to permit ingress and egress by users.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A suspended insect proof protective enclosure for use in the outdoor or indoor environment having an overhead support, comprising:

(a) a generally rectangular enclosure being composed of insect proof netting fabric and having a generally rectangular top wall defining sides, ends and corners, said rectangular enclosure having a pair of side walls and a pair of end walls each extending downwardly from respective sides and ends of said top wall;

(b) weight means being provided at the bottom of said side and end walls for establishing firm engagement of said side and end walls with a surface;

(c) a plurality of support pockets being defined at corners and sides of said top wall;

(d) at least one longitudinal intermediate support rod extending between and in parallel relation with said sides of said top wall and having respective ends thereof located within respective support pockets located substantially centrally of respective ends of said top wall;

(e) a pair of transverse end support rods extending along respective ends of said top wall and having respective ends thereof located within respective support pockets located at corners of said top wall;

(f) an intermediate transverse support rod being oriented between and in parallel relation with said transverse end support rods and having respective ends thereof located within respective support pockets located substantially intermediate said sides of said top wall; and (g) a support bridle being connected with at least one of said support rods and having a single support cord for suspending said insect proof protective enclosure from said overhead support.

2. The suspended insect proof protective enclosure of claim 1, wherein said weight means comprises:

(a) receptacle means being defined at the bottom of said side and end walls; and (b) at least one weight element being located within said weight receptacle means and urging said side and end walls downwardly for establishing said insect sealed engagement of said side and end walls with said surface.

3. The suspended insect proof protective enclosure of claim 1, wherein said at least one weight element comprises:

a length of chain rope being located within said weight receptacle of said side and end walls and urging substantially the entirety of said side and end wails into firm insect sealed engagement with said surface.

4. The suspended insect proof protective enclosure of claim 1, further comprising:

a generally rectangular floor having sides and ends being connected in insect sealed relation with said side and end walls.

5. The suspended insect proof protective enclosure of claim 1, wherein:

said plurality of support rods are composed of interconnectable rod joints and are capable of being disassembled for storage.

6. The suspended insect proof protective enclosure of claim 1, wherein:

said plurality of interconnectable rod joints of each of said plurality of support rods are interconnected by elastic strip material permitting the interconnectable rod joints of each support rod to remain interconnected and capable of being folded when disassembled.

7. The suspended insect proof protective enclosure of claim 1, wherein said plurality of support pockets comprises:

(a) a plurality of generally rectangular fabric patches defining peripheral edges, three of said peripheral edges being attached to said netting fabric of said top wall and cooperating therewith to define a pocket having a pocket opening; and (b) wherein a respective end of one of said support rods is received through said pocket opening and is received within said pocket.

8. The suspended insect proof protective enclosure of claim 1, wherein said means defining a plurality of support pockets comprises:

(a) fabric patches being attached to each corner of said top wall and defining corner pockets each defining a pocket opening facing toward an opposite corner pocket;

(b) said plurality of support rods including a pair of transverse end support rods being located at respective ends of said top wall and having respective ends thereof received within opposed corner pockets;

(c) a floor being interconnected in insect sealed relation with said side and end walls; and (d) at least one of said side walls having an opening having fastening means for opening and closing thereof.

9. The suspended insect proof protective enclosure of claim 8, further comprising:

(a) a pair of intermediate fabric patches being fixed to said top wall and cooperating therewith to define a pair of intermediate support pockets located at said sides of said top wall; and (b) an intermediate transverse support rod extending transversely of said top wall and having respective ends thereof located within said intermediate support pockets.

10. The suspended insect proof protective enclosure of claim 8, further comprising:

(a) a pair of intermediate pocket patches being fixed to said top wall intermediate said ends and cooperating with said top wall to define a pair of intermediate support pockets located at said ends of said top wall;

(b) a longitudinal support rod extending longitudinally and substantially centrally of said top wall and having respective ends thereof located within said intermediate support pockets; and (c) a central support patch being fixed substantially centrally of said top wall and cooperating with said top wall to define a through passage receiving said longitudinal intermediate support rod.

11. The suspended insect proof protective enclosure of claim 10, further comprising:

a support ring being connected to said central support patch and receiving said intermediate transverse support rod.

12. The suspended insect proof protective enclosure of claim 10, further comprising:

(a) a pair of intermediate support patches being fixed to said top wall and being located on opposite sides of said central support patch; and (b) a pair of support rings being connected respectively to said intermediate support patches and receiving said longitudinal support rod therein.

13. The suspended insect proof protective enclosure of claim 12, wherein said support bridle comprises:

(a) a pair of bridle elements each being connected to said longitudinal intermediate support rod and having upper ends thereof interconnected; and (b) a single bridle element being connected to said pair of bridle elements at said connection thereof and adapted for connection to an overhead support.

14. A suspended insect proof protective enclosure for use in the outdoor or indoor environment having an overhead support, comprising:

(a) a generally rectangular enclosure being composed of insect proof netting fabric and having a generally rectangular top wall defining sides ends and corners, said rectangular enclosure having a pair of side walls and a pair of end walls each extending downwardly from respective sides and ends of said top wall;

(b) elongate weight pockets being defined at the lower ends of said side walls and said end walls;

(c) weight means being received within said elongate weight pockets and establishing firm engagement of said side and end walls with a surface;

(d) a plurality of support pocket patches being connected to said top wall and defining a plurality of support pockets at corners, sides and ends of said top wall, said support pocket patches each comprising:

(1) a plurality of generally rectangular fabric patches defining peripheral edges, three of said peripheral edges being attached to said netting fabric of said top wall and cooperating therewith to define a pocket having a pocket opening;

(2) wherein a respective end of one of said support rods is received through said pocket opening and is received within said pocket;

(3) a floor being interconnected in insect sealed relation with said side and end walls; and (4) at least one of said walls having an ingress opening having fastening means for opening and closing thereof;

(e) a plurality of transverse support rods having respective ends thereof disposed in supporting engagement within respective support pockets and defining a frame work;

(f) a longitudinal support rod extending centrally of said top wall and having respective ends thereof located within respective end support pockets located centrally of respective ends of said top wall;

(g) a central support patch being connected substantially centrally of said top wall and supporting the central portion of said top wall from said longitudinal support rod; and (h) a support bridle being connected with at least one of said support rods and having a single support cord for suspending said insect proof protective enclosure from said overhead support.

15. The suspended insect proof protective enclosure of claim 14, wherein said weight means comprises:

(a) receptacle means being defined at the bottom of said side and end walls; and (b) at least one weight element being located within said weight receptacle means and urging said side and end walls downwardly for establishing said insect sealed engagement of said side and end walls with said surface.

16. The suspended insect proof protective enclosure of claim 14, wherein said a plurality of support pockets comprises:

(a) fabric patches being attached to each corner of said top wall and defining corner pockets each defining a pocket opening facing toward an opposite corner pocket;

(b) said plurality of support rods including a pair of transverse end support rods being located at respective ends of said top wall and having respective ends thereof received within opposed corner pockets;

(c) a pair of intermediate pocket patches being fixed to said top wall and cooperating therewith to define a pair of intermediate support pockets located at said sides of said top wall;

(d) an intermediate transverse support rod extending transversely of said top wall and having respective ends thereof located within said intermediate support pockets;

(e) a pair of intermediate pocket patches being fixed to said top wall intermediate said ends and cooperating with said top wall to define a pair of intermediate support pockets located at said ends of said top wall;

(f) a longitudinal support rod extending longitudinally and substantially centrally of said top wall and having respective ends thereof located within said intermediate support pockets; and (g) a central support patch being fixed substantially centrally of said top wall and cooperating with said top wall to define a through passage receiving said central support rod.

17. The suspended insect proof protective enclosure of claim 16, further comprising:

(a) a support ring being connected to said central support patch and receiving said intermediate transverse support rod;

(b) a pair of intermediate support patches being fixed to said top wall and being located on opposite sides of said central support patch; and (c) a pair of support rings being connected respectively to said intermediate support patches and receiving said longitudinal support rod therein.

18. The suspended insect proof protective enclosure of claim 17, further comprising:

(a) a pair of bridle elements each being connected to said longitudinal support rod and having upper ends thereof interconnected; and (b) a single bridle element being connected to said pair of bridle elements at said connection thereof and adapted for connection to an overhead support.

19. An insect proof protective enclosure adapted to be suspended from an overhead support, comprising:

(a) a generally rectangular enclosure composed of insect proof net fabric material and defining a substantially horizontally oriented generally rectangular top wall defining side edges and end edges and substantially rectangular side walls and end walls being interconnected with said side and end edges of said top wall, (b) a plurality of support pockets being provided at said side edges and said end edges and comprising:

(1) a plurality of generally rectangular fabric patches defining peripheral edges, three of said peripheral edges being attached to said netting fabric of said top wall and cooperating therewith to define a pocket having a pocket opening;

(2) wherein a respective end of one of said support rods is received through said pocket opening and is received within said pocket;

(3) a floor being interconnected in insect sealed relation with said side and end walls; and (4) at least one of said walls having an ingress opening having fastening means for opening and closing thereof;

(c) a support framework being in integral assembly with said top wall and comprising:

(1) a plurality of transverse support rods defining ends and being disposed in substantially parallel relation with one another, two of said transverse support rods extending along respective ends of said top wall, at least one of said transverse support rods being located intermediate said ends of said top wall, said ends of said transverse support rods being received within respective support pockets; and (2) a longitudinal spine support rod defining ends and extending along said top wall with respective ends thereof located at respective end edges of said top wall, said longitudinal spine rod intersecting each of said transverse support rods said ends of said longitudinal spine rod being received within respective support pockets;

(d) means releasably securing said transverse support rods and said longitudinal spine support rod to said top wall; and (e) a support bridle being interconnected with said support framework and having means for attachment thereof to said overhead support said support bridle comprising:

(f) a pair of bridle elements each being connected to said longitudinal support rod and having upper ends thereof interconnected; and (f) a single bridle element being connected to said pair of bridle elements at said connection thereof and adapted for connection to an overhead support.

* * * * *